US011072965B2

(12) United States Patent
Soderqvist

(10) Patent No.: US 11,072,965 B2
(45) Date of Patent: Jul. 27, 2021

(54) AUTOMATIC DOOR OPERATOR FOR A SWING DOOR ASSEMBLY

(71) Applicant: ASSA ABLOY ENTRANCE SYSTEMS AB, Landskrona (SE)

(72) Inventor: Sven-Gunnar Soderqvist, Vallakra (SE)

(73) Assignee: Assa Abloy Entrance Systems AB, Landskrona (SE)

( * ) Notice: Subject to any disclaimer, the term of this patent is extended or adjusted under 35 U.S.C. 154(b) by 181 days.

(21) Appl. No.: 16/347,966

(22) PCT Filed: Dec. 5, 2017

(86) PCT No.: PCT/EP2017/081436

§ 371 (c)(1),
(2) Date: May 7, 2019

(87) PCT Pub. No.: WO2018/104258

PCT Pub. Date: Jun. 14, 2018

(65) Prior Publication Data

US 2019/0292835 A1 Sep. 26, 2019

(30) Foreign Application Priority Data

Dec. 7, 2016 (SE) ..... 1630292-9

(51) Int. Cl.
*E06B 3/00* (2006.01)
*E05F 15/72* (2015.01)
(Continued)

(52) U.S. Cl.
CPC ..... *E05F 15/72* (2015.01); *E05F 1/006* (2013.01); *E05F 15/63* (2015.01); *E05F 15/79* (2015.01);
(Continued)

(58) Field of Classification Search
CPC . E05F 15/72; E05F 15/63; E05F 15/79; E05F 1/006; E05Y 2800/112;
(Continued)

(56) References Cited

U.S. PATENT DOCUMENTS 3,777,423 A * 12/1973 Coulter ..... E05F 3/222 49/31
3,905,063 A * 9/1975 Coulter ..... A62C 2/12 16/48.5
(Continued)

FOREIGN PATENT DOCUMENTS

| | | |
|---|---|---|
| DE | 3612918 | 10/1987 |
| DE | 102015104825 | 7/2016 |
| KR | 20110001581 | 1/2011 |

OTHER PUBLICATIONS

International Search Report and Written Opinion mailed in PCT/EP2017/060488 dated Mar. 12, 2018.
(Continued)

*Primary Examiner* — Jerry E Redman
(74) *Attorney, Agent, or Firm* — Wissing Miller LLP

(57) ABSTRACT

An automatic door operator (30) for a swing door assembly (10) having a door leaf (14) rotationally supported by a door frame (12) is disclosed. The automatic door operator has a motor (34) for causing opening of the door leaf (14) with respect to the door frame (12), and a controller (31) being configured for performing different functions (60) of the automatic door operator. The controller (31) is configured to detect (42) a movement of the door leaf (14), not caused by the motor (34), identify (44) a predefined movement matching the detected movement, determine (46), among the different functions, a function (61-A, 61-B) being associated with the predefined movement, and perform (48) the determined function.

20 Claims, 6 Drawing Sheets

(51) Int. Cl.
*E05F 15/63* (2015.01)
*E05F 15/79* (2015.01)
*E05F 1/00* (2006.01)

(52) U.S. Cl.
CPC ..... *E05Y 2400/32* (2013.01); *E05Y 2400/356* (2013.01); *E05Y 2400/40* (2013.01); *E05Y 2800/112* (2013.01); *E05Y 2800/25* (2013.01); *E05Y 2900/134* (2013.01)

(58) Field of Classification Search
CPC ..... E05Y 2800/25; E05Y 2400/356; E05Y 2400/32; E05Y 2400/40; E05Y 2900/134
USPC ..... 49/506
See application file for complete search history.

(56) References Cited

U.S. PATENT DOCUMENTS 3,908,309 A * 9/1975 Coulter ..... E05F 3/222 49/31
3,926,461 A * 12/1975 D'Hooge ..... E05F 3/222 292/275
3,934,306 A * 1/1976 Farris ..... E05F 3/223 16/48.5
4,501,090 A * 2/1985 Yoshida ..... E05F 3/102 49/264
4,952,080 A 8/1990 Boiucaner
5,018,304 A * 5/1991 Longoria ..... E05F 15/63 49/26
5,878,530 A * 3/1999 Eccleston ..... E05F 15/63 49/139
6,283,189 B1 * 9/2001 Liebscher ..... E05F 15/72 160/9
6,891,479 B1 5/2005 Eccleston
7,310,911 B1 * 12/2007 Sellman ..... E05F 15/41 192/18 B
8,225,458 B1 7/2012 Hoffberg
8,527,101 B2 * 9/2013 Burris ..... E05F 3/102 700/282
8,773,237 B2 * 7/2014 Burris ..... G05B 19/0426 340/3.32
9,995,076 B1 * 6/2018 Hoffberg ..... E05F 3/10
10,648,208 B2 * 5/2020 Eickhoff ..... G07C 9/00174
2002/0104266 A1 8/2002 Ranaudo
2004/0183677 A1 * 9/2004 Fitzgibbon ..... E05F 15/72 340/540
2005/0091928 A1 * 5/2005 Okulov ..... E05F 15/622 49/341
2007/0108927 A1 5/2007 Valencia
2007/0277440 A1 * 12/2007 Luetkenhaus ..... E05F 15/63 49/139
2009/0249699 A1 10/2009 Yulkowski
2009/0265992 A1 10/2009 Hass
2010/0115853 A1 5/2010 Gebhart et al.
2012/0240474 A1 * 9/2012 Purssey ..... E05F 3/221 49/506
2020/0300026 A1 * 9/2020 Lawhon ..... G05B 19/0426

OTHER PUBLICATIONS

SE International-Type Search Report mailed in SE 1630292-9 dated Aug. 30, 2017.

* cited by examiner

A method for providing user interaction with an automatic door operator in a door operating system:

A method for providing user interaction with an automatic door operator in a door operating system:

AUTOMATIC DOOR OPERATOR FOR A SWING DOOR ASSEMBLY

This application is a 371 of PCT/EP2017/081436 filed on Dec. 5, 2017, published on Jun. 14, 2018 under publication number WO 2018/104258, which claims priority benefits from Swedish Patent Application No. 1630292-9 filed on Dec. 7, 2016, the disclosure of which is incorporated herein by reference.

TECHNICAL FIELD

The present invention relates to the technical field of motorized doors. More specifically, the present invention relates to an automatic door operator for a swing door assembly having a door leaf rotationally supported by a door frame. The present invention also relates to a door operating system comprising such an automatic door operator, and to a method for providing user interaction with an automatic door operator in a door operating system.

BACKGROUND

Automatic door operators are frequently used for providing automatic opening and sometimes closing of one or more door leaves of a swing door assembly, in order to facilitate entrance and exit to buildings, rooms and other areas.

Since automatic door operators are typically used in public areas, it may be desired to allow a clean and aesthetically appealing installation where separate buttons, actuators, etc, as well as the wiring thereof to the automatic door operator, be avoided. This may also be beneficial for cost-saving reasons (less components) as well as safety reasons (no external components exposed to wear and tear).

On the other hand, there are situations where it is desired to allow a human user to interact with the automatic door operator in order to control a function thereof.

Accordingly, there are rooms for improvements in the situations referred to above.

SUMMARY

An object of the present invention is therefore to provide a solution to or at least a mitigation of one or more of the problems or drawbacks identified in the background section above.

The present inventors have realized, after insightful consideration, that human interaction with automatic door operators may be provided in a novel and inventive way, which avoids the drawbacks above. By appropriately configuring a controller in the automatic door operator, intentional manual movements of the door leaf in certain situations may be detected and used as commands for controlling one or more of the functions of the automatic door operator.

The present inventors have furthermore realized that there might in fact be a number of different functions of automatic door operators which can be controlled in a number of given situations in this novel and inventive way.

A first aspect of the present invention is an automatic door operator for a swing door assembly having a door leaf rotationally supported by a door frame. The automatic door operator comprises a motor for causing opening of the door leaf with respect to the door frame, and a controller being configured for performing different functions of the automatic door operator. The controller is configured to: detect a movement of the door leaf, not caused by said motor; identify a predefined movement matching the detected movement; determine, among said different functions, a function being associated with the predefined movement; and cause performance of the determined function.

The purpose of the detection of the movement is to allow that an intentional manual movement of the door leaf in a certain situation can be used for controlling one or more of the functions of the automatic door operator. The predefined movement therefore preferably represents an intentional manual movement of the door leaf by human intervention. This approach solves or at least mitigates one or more of the problems or drawbacks identified in the background section above, as will be clear from the following detailed description section.

An automatic door operator according to this aspect of the present invention solves or at least mitigates one or more of the problems or drawbacks identified in the background section above.

A second aspect of the present invention is a door operating system, comprising an automatic door operator according to the first aspect, a door frame, a swing door assembly having a door leaf rotationally supported by the door frame, and a linkage mechanism connecting the automatic door operator to the door leaf.

A third aspect of the present invention is a method for providing user interaction with an automatic door operator in a door operating system which furthermore comprises a door frame, a swing door assembly having a door leaf rotationally supported by the door frame, and a linkage mechanism connecting the automatic door operator to the door leaf. The method comprises: detecting a movement of the door leaf, not caused by a motor of said automatic door operator; identifying a predefined movement matching the detected movement; determining, among different functions of the automatic door operator, a function being associated with the predefined movement; and causing performance of the determined function.

Embodiments of the invention are defined by the appended dependent claims and are further explained in the detailed description section as well as on the drawings.

It should be emphasized that the term "comprises/comprising" when used in this specification is taken to specify the presence of stated features, integers, steps, or components, but does not preclude the presence or addition of one or more other features, integers, steps, components, or groups thereof. All terms used in the claims are to be interpreted according to their ordinary meaning in the technical field, unless explicitly defined otherwise herein. All references to "a/an/the [element, device, component, means, step, etc]" are to be interpreted openly as referring to at least one instance of the element, device, component, means, step, etc., unless explicitly stated otherwise. The steps of any method disclosed herein do not have to be performed in the exact order disclosed, unless explicitly stated.

BRIEF DESCRIPTION OF THE DRAWINGS

Objects, features and advantages of embodiments of the invention will appear from the following detailed description, reference being made to the accompanying drawings.

DETAILED DESCRIPTION OF EMBODIMENTS

Figure 1:
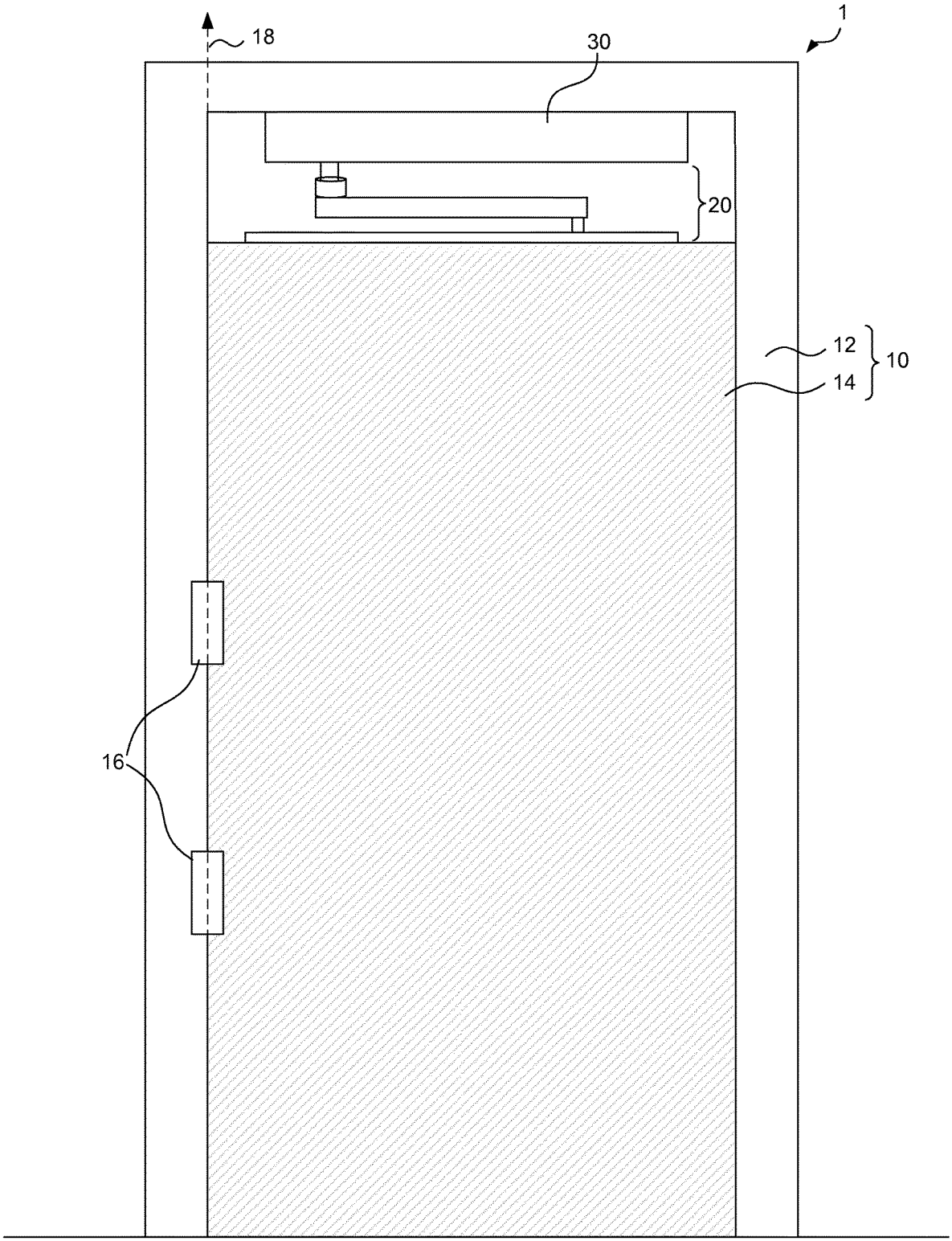
FIG. 1 is a schematic front view of a door operating system including an automatic door operator for a door leaf of a swing door assembly according to one embodiment.

Embodiments of the invention will now be described with reference to the accompanying drawings. The invention may, however, be embodied in many different forms and should not be construed as limited to the embodiments set forth herein; rather, these embodiments are provided so that this disclosure will be thorough and complete, and will fully convey the scope of the invention to those skilled in the art. The terminology used in the detailed description of the particular embodiments illustrated in the accompanying drawings is not intended to be limiting of the invention. In the drawings, like numbers refer to like elements.

FIG. 1 is a schematic front view of a door operating system 1. The door operating system 1 comprises a swing door assembly 10. The swing door assembly 10 includes a door frame 12 and a door leaf 14 which is connected to the door frame 12 by door hinges 16 and hence supported by the door frame 12 for pivotal motion around a rotational axis 18.

The door leaf 14 may be a door design made from one or more suitable materials such as wood, metal, plastic, glass or composite material. In some embodiments, the door leaf 14 is a fire proof door leaf having a fire resistant core made of various materials, as is generally well known in the art. Fire doors are arranged to stop or delay the transfer of thermal energy, i.e. heat, from one side of the door to another side.

In the disclosed embodiment, the swing door assembly 10 comprises a single door leaf 14. In other embodiments, the swing door assembly 10 may instead comprise a pair of door leaves, as is generally well known in the art.

The door operating system 1 also includes an automatic door operator 30 and a linkage mechanism 20 connecting the automatic door operator 30 to the door leaf 14. The door operator 30 may be arranged in conjunction with the door frame 12, typically as a concealed overhead installation in or at the door frame 12.

Via the linkage mechanism 20, the automatic door operator 30 may serve to provide automatic opening and sometimes closing of the door leaf 14 in various possible applications including, for instance, facilitating a disabled person's access to his or her private home, providing access through entrance ports or internal doors at office premises, industries or retail stores, providing comfort access to hotel rooms, etc. The automatic door operator 30 may also be used in different fire door applications.

Figure 2:
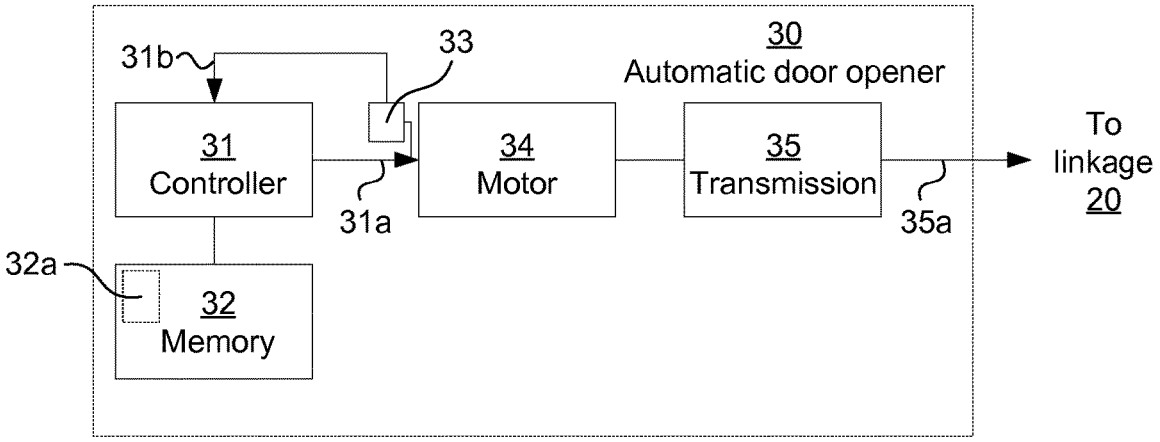
FIG. 2 is a schematic block diagram of an automatic door operator according to a first embodiment.

A first embodiment of the automatic door operator 30 is shown in FIG. 2. The automatic door operator 30 comprises a motor 34, typically an electrical motor, being connected to a transmission 35. An output shaft 35*a* of the transmission 35 rotates upon activation of the motor 34 and is connected to the linkage mechanism 20. The linkage mechanism 20 translates the motion of the output shaft 35*a* into an opening motion of the door leaf 14 with respect to the door frame 12.

The automatic door operator 30 also comprises a controller 31 which is configured for performing different functions of the automatic door operator 30. Such different functions are schematically illustrated at 60 in FIG. 8. One or more of the functions relates to opening of the door leaf 14 with respect to the door frame 12. Accordingly, the controller 31 has a control output 31*a* connected to the motor 34 for controlling the actuation thereof.

A revolution counter 33, such as an encoder or other angular sensor, is provided at the motor 34 to monitor the revolution of a motor shaft of the motor 34. The revolution counter is connected to an input 31*b* of the controller 31. The controller 31 is configured to use one or more readings of the revolution counter 33 for determining a current angular position of the door leaf 14.

The controller 31 may be implemented in any known controller technology, including but not limited to microcontroller, processor (e.g. PLC, CPU, DSP), FPGA, ASIC or any other suitable digital and/or analog circuitry capable of performing the intended functionality.

The controller 31 has an associated memory 32. The memory 32 may be implemented in any known memory technology, including but not limited to E(E)PROM, S(D)RAM or flash memory. In some embodiment, the memory 32 may be integrated with or internal to the controller 31. The memory 32 may store program instruction for execution by the controller 31, as well as temporary and permanent data used by the controller 31.

Figure 3:
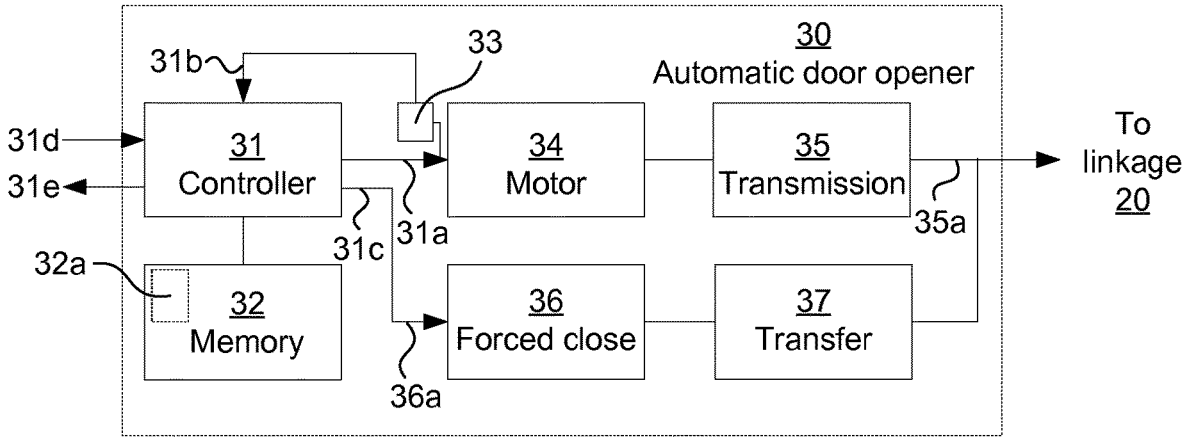
FIG. 3 is a schematic block diagram of an automatic door operator according to a second embodiment.

A second embodiment of the automatic door operator 30 is shown in FIG. 3. The second embodiment is intended for fire door applications. As for the first embodiment, the second embodiment of the automatic door operator 30 comprises a controller 31, memory 32, revolution counter 33, motor 34 and transmission 35. In addition to this, the second embodiment of the automatic door operator 30 comprises a forced close arrangement 36 adapted to provide mechanical energy via a transfer mechanism 37 to the linkage 20, so as to cause forced closing of the door leaf 14 with respect to the door frame 12 in the event of a fire alarm.

In the disclosed embodiment, the forced close arrangement 36 comprises a helical compression spring. During opening of the door, the compression spring is tensioned by the rotation of the output shaft 35*a*. During the forced closing cycle, the accumulated spring force is transferred to the output shaft 35 by means of the transfer mechanism 37 which in the disclosed embodiment includes a pressure roller that acts on a cam curve being connected to the output shaft 35*a*. In other embodiments, the forced close arrangement 36 may comprise a different kind of spring, and the transfer mechanism 37 may comprise a different kind of mechanism.

The controller 31 may receive an external fire alarm signal via a control input 31*d* and generate a control signal 36*a* to the forced close arrangement 36, so as to cause release of the accumulated spring force.

Embodiments of the novel and inventive way of providing human interaction with the automatic door operator 30 will now be described with reference to the remaining figures. As will be clear from the following, the controller 31 in the automatic door operator 30 is configured to detect intentional manual movements of the door leaf 14 in certain given situations, and to use such detected movements as commands for controlling one or more of the functions 60 of the automatic door operator 30. Corresponding methods are described in FIGS. 6 and 7.

Figure 8:
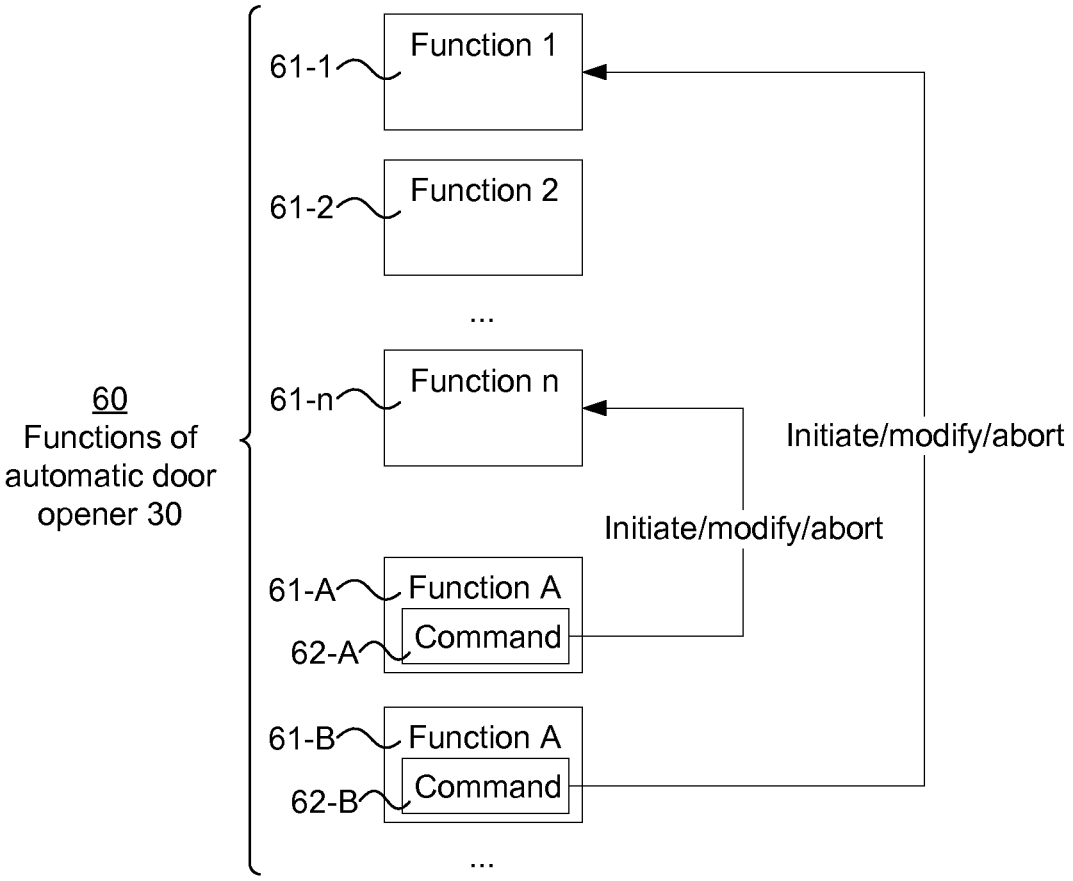
FIG. 8 is a schematic illustration of different functions 60 of the automatic door operator, performable by a controller thereof.

First, as seen in FIG. 8, the automatic door operator 30 has various different functions 60, performable by the controller 31. The functions include a first group of functions 61-1, 61-2, . . . , **61-*n* which can be seen as ordinary functions of a typical automatic door operator, relating to various aspects of automatic door opening and closing as well as possible other automatic functions related to, for instance fire alarms. Hence, the first group of functions 61-1, 61-2, . . . , 61-*n*** may consist of functions which are known per se from typical automatic door openers available on the market.

In addition, a second group of functions 61-A, 61-B, . . . , is provided (the group may consist of an arbitrary number of functions including a single function). According to the invention, the functions 61-A, 61-B, . . . comprise respective commands 62-A, 62-B, . . . for initiating, modifying or aborting respective functions **61-*n*, 61-1 of the first group of functions 61-1, 61-2, . . . , 61-*n* of the automatic door operator performable by the controller 31. Examples will be given later with reference to FIGS. 4 and 5**.

Figure 6:
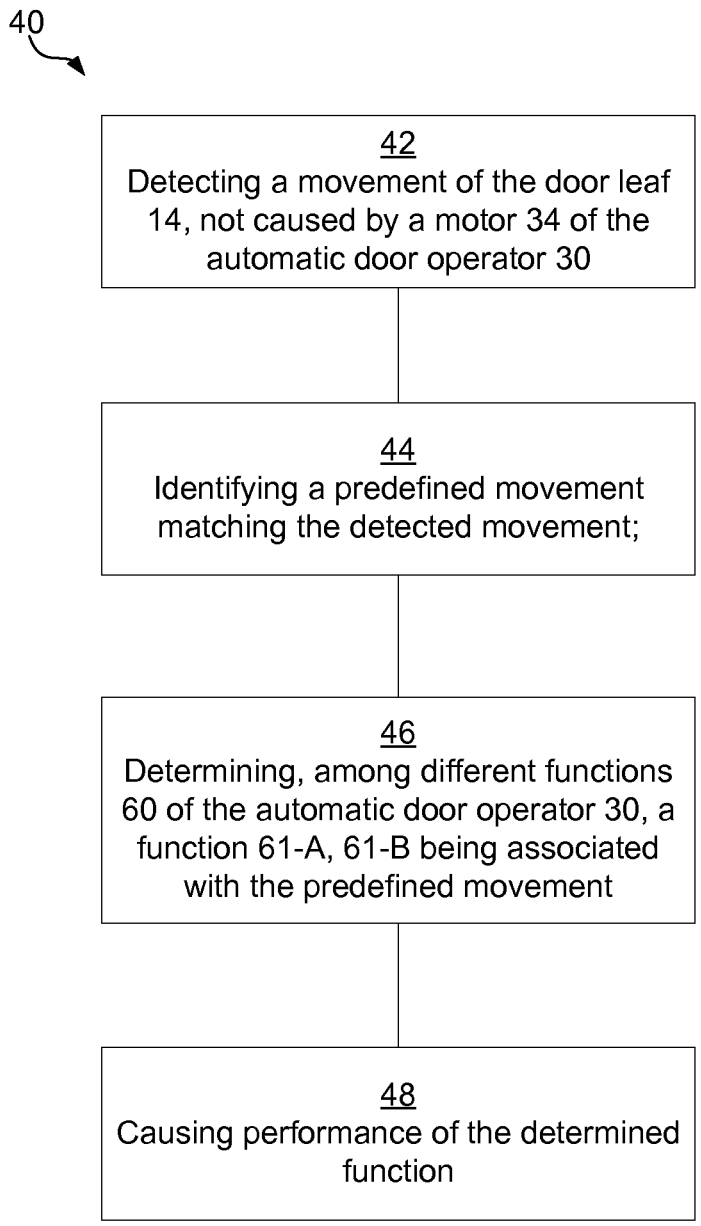
FIG. 6 is a flowchart diagram illustrating a method for providing user interaction with an automatic door operator in a door operating system according to a first embodiment, the method involving detection of an intentional manual movement of the door leaf by human intervention.

Reference is now made to FIG. 6 which illustrates a method for providing user interaction with the automatic door operator 30 according to a first embodiment. The method involves detection of an intentional manual movement of the door leaf 14 by human intervention and includes the following steps.

In step 42 in FIG. 6, the controller 31 is configured to detect a movement of the door leaf 14. The movement is not caused by the motor 34 but rather by human intervention to cause intentional manual movement of the door leaf 14. Since the controller 31 is in control of the actuation of the motor 34, the controller 31 may easily recognize when a movement is not caused by the motor 34.

The controller 31 is configured to use one or more readings of the revolution counter 33 for determining a current angular position of the door leaf 14. The controller 31 is configured to use the determined current angular position for detecting the movement of the door leaf 14. For embodiments like in FIG. 1, where the swing door assembly 10 comprises a single door leaf 14, the movement will of course be detected for this single door leaf. In other embodiments where the swing door assembly 10 comprises a pair of door leaves, the movement may be detected for one of the door leaves in the pair.

In step 44 in FIG. 6, the controller 31 is configured to identify a predefined movement which matches the detected movement. To this end, the memory 32 may be adapted to store a definition **32*a* of such a predefined movement. The definition may comprise data representing a defined door leaf angle (such as any of angles α or β seen in FIG. 4 or 5). The defined door leaf angle may be expressed as an absolute angle between the door leaf 14 and the door frame 12, or as a relative angle between the door leaf 14 and a reference door leaf angle representing either an open position (such as position γ in FIGS. 4 and 5) or a closed position (such as position δ in FIGS. 4 and 5) of the door leaf 14 with respect to the door frame 12**.

In step 46 in FIG. 6, the controller 31 is configured to determine, among the different functions 60 of the automatic door operator 30, a function 61-A or 61-B being associated with the predefined movement. To this end, the memory 32 may advantageously be adapted to store definitions of a plurality of predefined movements and respective functions 61-A, 61-B being associated therewith. Hence, the controller 31 may be configured to compare the detected movement to the definitions of the plurality of predefined movements, and identify the predefined movement as the one among the plurality of predefined movements the definition of which matches the detected movement.

In step 48 in FIG. 6, the controller 31 is configured to cause performance of the determined function 61-A or 61-B. Advantageously, the determined function 61-A, 61-B comprises a command 62-A, 62-B for initiating, modifying or aborting another one **61-*n*, 61-1 of the different functions 60 of the automatic door operator performable by the controller 31. Hence, advantageously, the determined function 61-A or 61-B is determined among the second group of functions as explained above with reference to FIG. 8. The command 62-A or 62-B comprised in the determined function 61-A or 61-B accordingly initiates, modifies or aborts one of the functions in the first group of functions 61-1, 61-2, . . . , 61-*n*, as explained above with reference to FIG. 8**.

For instance, in the example given in FIG. 8, when the determined function is function 61-A in the second group of functions, its command 62-A initiates, modifies or aborts function **61-*n* in the first group of functions. When the determined function is function 61-B in the second group of functions, its command 62-B initiates, modifies or aborts function 61-1** in the first group of functions.

Figure 7:
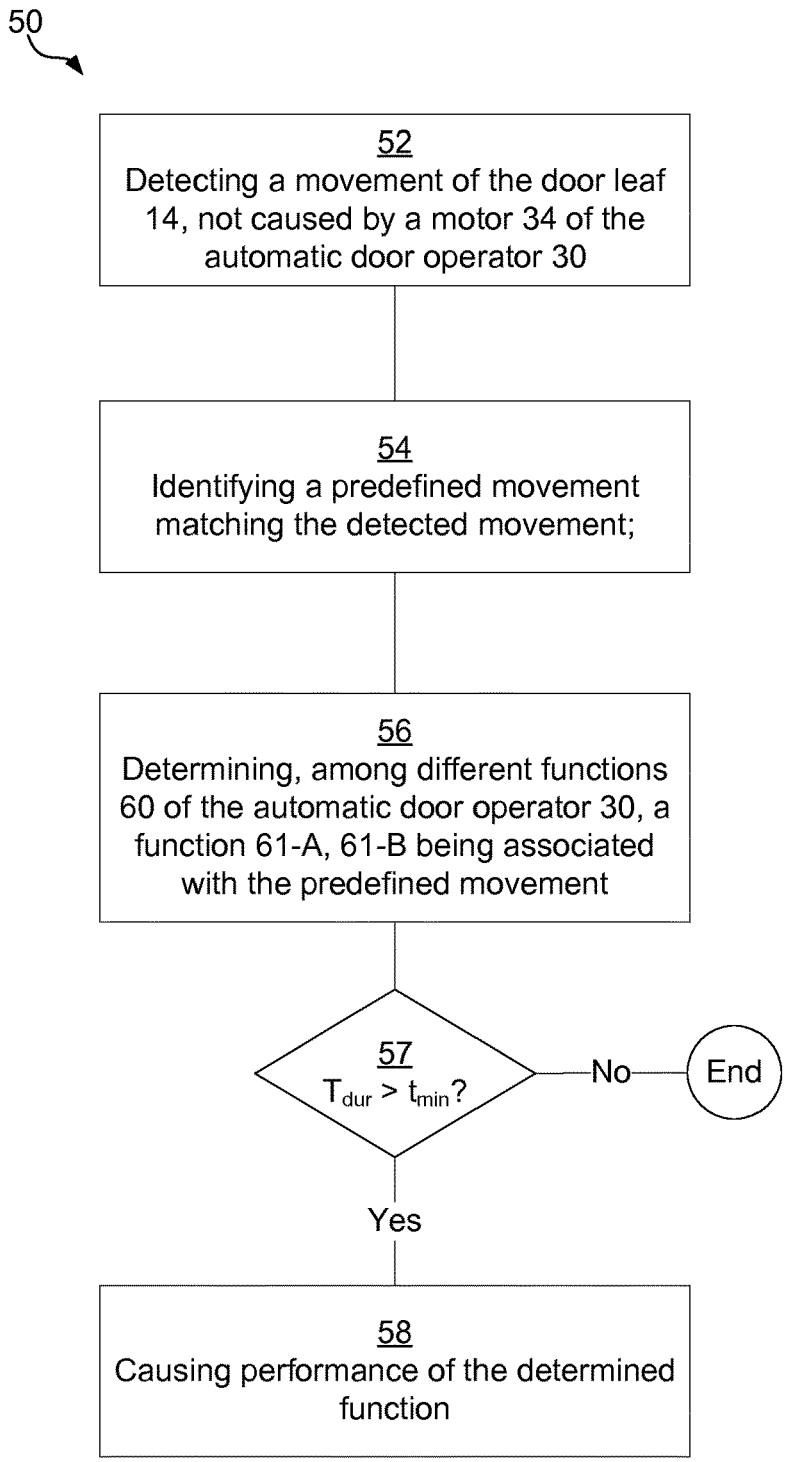
FIG. 7 is a flowchart diagram illustrating a method for providing user interaction with an automatic door operator in a door operating system according to a second embodiment.

Reference is now made to FIG. 7 which illustrates a method for providing user interaction with the automatic door operator 30 according to a second embodiment. Just as for the method of FIG. 6, the method of FIG. 7 involves detection of an intentional manual movement of the door leaf 14 by human intervention. Accordingly, the method of FIG. 7 includes steps 52, 54, 56 and 58 which are identical or at least essentially identical to the steps 42, 44, 46 and 48 of the method of FIG. 6.

In addition, according to the method of FIG. 7, the controller 31 is configured to determine a time duration $t_{dur}$ during which the current angular position of the door leaf 14 has satisfied the defined door leaf angle (such as any of angles α or β seen in FIG. 4 or 5) in the definition of the predefined movement, and to cause the performance of the determined function only if the determined time duration $t_{dur}$ exceeds a threshold time $t_{min}$. This functionality is seen in step 57 of FIG. 7 and has an advantage in that it eliminates or at least reduces the risk for spurious—as contrasted to intended—intervention with the door leaf 14.

The value of $t_{min}$ may be set to an appropriate value, such as for instance n seconds, where $1.0 \leq n \leq 5.0$. In the embodiments described below for FIGS. 4 and 5, $t_{min}$ may be set to, for instance, about 2 seconds. The value of $t_{min}$ may be configurable in some embodiments.

A number of use cases will now be described with reference to FIGS. 4 and 5.

Use Case 1—Aborting Hold Open

In this use case, one of the functions in the first group of functions 61-1, 61-2, . . . , **61-*n* in FIG. 8** is a hold open function. Certain requirements, for instance ANSI 156.19, requires a minimum hold open time of, e.g., 5 seconds after opening of a door leaf by an automatic door opener. This feature is often convenient, for instance when the automatic door opener is used for a hotel room and the user carries luggage for instance when entering the hotel room for the first time. Another example is when a handicapped person enters through a restroom door.

However, in other situations, the hold open might potentially be very inconvenient when, for instance, the automatic door opener is used in a restroom or hotel room. The inconvenience is since the door is kept open for seconds after the user has passed, the integrity of the user may be compromised by the external visibility into the room through an open door, or the opportunity for a trespasser to sneak into the room through the still open door.

Thanks to the present invention, a physical push or pull of the door towards the closed position by a number of degrees will in effect cancel this time delay. There is no need to install a separate push button or off switch to achieve such cancellation of the automatic hold open function. The present inventors have realized that the natural response for a person who is intimidated by an undesired hold open period will be to try and close the door by physically pulling or pushing it towards the closed position. Hence, the use case is believed to be advantageous also in the sense that the user will quite possibly need no prior knowledge on how to operate the door in order to abort the hold open period.

Figure 4:
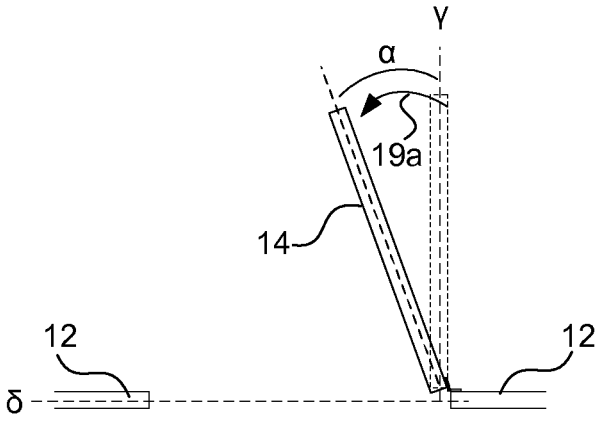
FIG. 4 is a schematic top view illustrating a first example of an intentional manual movement of the door leaf by human intervention, the manual movement serving to cause performance of a certain function which includes a command for initiating, modifying or aborting another one of the different functions of the automatic door operator.

The use case above is seen at a schematic level in FIG. 4, where the user makes an intentional manual movement 19*a* of the door leaf 14 to cause abortion of the automatic hold open function if the movement of the door leaf 14 occurs during the automatic hold open period. The intentional movement 19*a* of the door leaf 14 is at least α' degrees from the open position γ towards the closed position δ of the door leaf 14. Hence, in this use case, the defined door leaf angle α in the definition of the predefined movement is α' degrees less than the reference door leaf angle of the door leaf 14 in the open position γ. The value α' of the defined door leaf angle α may be a preset suitable value, such as for instance any value between 5 and 20 degrees, and may optionally be configurable. Other values less than 5 degrees or more than 20 degrees are however also possible; for instance values less than 5 degrees may be appropriate in some applications.

The controller 31 detects the intentional movement 19*a*, finds that it matches the predefined movement, determines that the predefined movement is associated with a function (among functions 61-A and 61-B in FIG. 8), and causes the determined function to be performed by executing the command (62-A or 62-B) comprised therein. The command causes abortion of the automatic hold open function (among functions 61-1, 61-2, . . . , 61-*n* in FIG. 8), whereupon the door leaf 14 will be immediately closed.

Use Case 2—Manual Hold Open

Also in this use case, the different functions 60 of the automatic door operator performable by the controller 31 include an automatic hold open function to keep the door leaf 14 open during an automatic hold open period. However, the determined function in this use case is instead to initiate the automatic hold open function when the door leaf is initially in a closed position. This use case is illustrated in FIG. 5.

In this use case, the defined door leaf angle β in the definition of the predefined movement is β' degrees more than the reference door leaf angle of the door leaf 14 in the open position γ. The predefined movement is hence defined as a movement of the door leaf 14 from the closed position δ towards and β' degrees past the open position γ. The value β' of the defined door leaf angle β may be a preset suitable value, such as for instance any value between 0.1 degrees and 10 degrees, and may optionally be configurable. In some embodiments, the value is preferably between 0.5 degrees and 1 degree. Other values, even larger than 10 degrees, are however also possible.

The controller 31 detects an intentional movement 19*b*, finds that it matches the predefined movement, determines that the predefined movement is associated with a function (among functions 61-A and 61-B in FIG. 8), and causes the determined function to be performed by executing the command (62-A or 62-B) comprised therein. The command causes initiation of the automatic hold open function (among functions 61-1, 61-2, . . . , 61-*n* in FIG. 8), whereupon the door leaf 14 will be held open. The hold open period may be the same as for a normal (automatic) hold open (for instance 5 s), or it may be a different period of time, such as for instance 2 s.

Use Case 3—Generate Fire Alarm

This use case is particularly suitable for the fire door embodiment of FIG. 3. In this use case, the different functions 60 of the automatic door operator performable by the controller 31 include generation of a fire alarm, and the determined function is to initiate the generation of the fire alarm.

Accordingly, similar to the aforementioned FIG. 4, the user may make an intentional manual movement 19*a* of the door leaf 14 to cause generation of a fire alarm when the door leaf 14 open. The intentional movement 19*a* of the door leaf 14 is at least α' degrees from the open position γ towards the closed position δ of the door leaf 14. Hence, in this use case, the defined door leaf angle α in the definition of the predefined movement is α" degrees less than the reference door leaf angle of the door leaf 14 in the open position γ. The value α" of the defined door leaf angle α may be a preset suitable value, such as for instance any value between 5 and 20 degrees, and may optionally be configurable. Other values less than 5 degrees or more than 20 degrees are however also possible; for instance values less than 5 degrees may be appropriate in some applications.

The controller 31 detects the intentional movement 19*a*, finds that it matches the predefined movement, determines that the predefined movement is associated with a function (among functions 61-A and 61-B in FIG. 8), and causes the determined function to be performed by executing the command (62-A or 62-B) comprised therein. The command causes generation of the fire alarm by invoking a fire alarm function (among functions 61-1, 61-2, . . . , 61-*n* in FIG. 8), whereupon the fire alarm may be generated. This may involve sending a control signal to an external system using an output 31*e* seen in FIG. 3. This may also involve sending a control signal 36*a* (FIG. 2) to the forced close arrangement 36.

Use Case 4—Reset after Fire Alarm

Also in this use case, the different functions 60 of the automatic door operator 30 performable by the controller 31 include generation of a fire alarm. However, in this use case, the determined function is instead to reset the automatic door operator 30 after a fire alarm has been generated.

Figure 5:
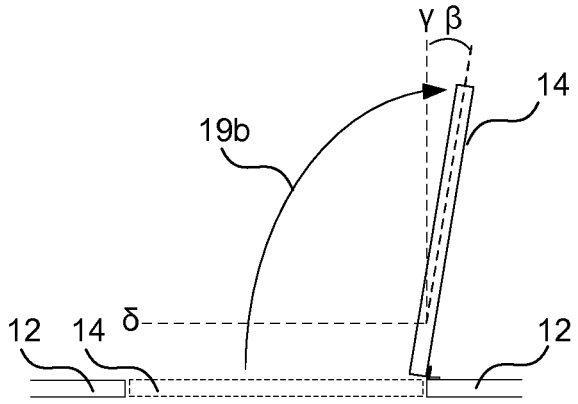
FIG. 5 is a schematic top view illustrating a second example of an intentional manual movement of the door leaf by human intervention.

In this use case, similar to the aforementioned FIG. 5, the defined door leaf angle β in the definition of the predefined movement is β" degrees more than the reference door leaf angle of the door leaf 14 in the open position γ. The predefined movement is hence defined as a movement of the door leaf 14 from the closed position δ towards and β" degrees past the open position γ. The value β" of the defined door leaf angle β may be a preset suitable value, such as for instance any value between 0.1 degrees and 10 degrees, and may optionally be configurable. In some embodiments, the value is preferably between 0.5 degrees and 1 degree. Other values, even larger than 10 degrees, are however also possible.

The controller 31 detects an intentional movement 19*b*, finds that it matches the predefined movement, determines that the predefined movement is associated with a function (among functions 61-A and 61-B in FIG. 8), and causes the determined function to be performed by executing the command (62-A or 62-B) comprised therein. The command causes reset of the automatic door operator 30 after a fire alarm has been generated. In turn, an automatic hold open function may then be invoked in some embodiments.

The invention has been described above in detail with reference to embodiments thereof. However, as is readily understood by those skilled in the art, other embodiments are equally possible within the scope of the present invention, as defined by the appended claims.

The invention claimed is:

1. An automatic door operator for a swing door assembly having a door leaf rotationally supported by a door frame and a linkage mechanism connecting the automatic door operator to the door, the automatic door operator comprising:

a motor for causing opening of the door leaf with respect to the door frame and a controller being configured for performing a plurality of functions of the automatic door operator and for storing a respective plurality of predefined movement trajecctories of the door leaf, ones of the functions being associated with respective ones of the predefined movement trajectories, characterized in that the controller is configured to:

detect a manual movement trajectory of the door leaf, wherein the manual movement trajectory is not caused by said motor;

identify a one of the predefined movement trajectories matching the detected manual, movement trajectory;

determine, among said plurality of functions, a selected function being associated with the one predefined movement trajectory; and cause performance of the selected function, wherein the automatic door operator further comprises a forced closed arrangement adapted to provide mechanical energy via a transfer mechanism to the linkage to cause a forced closing of the door leaf with respect to the door frame in response to a fire-alarm, and whereinn the selected function resets the automatic door operator after the fire alarm has been detected.

2. The automatic door operator as defined in claim 1, wherein the manual movement trajectory represents an intentional manual movement of the door leaf by human intervention.

3. The automatic door operator as defined in claim 1, further comprising a memory, the memory being adapted to store trajectory parameters of the plurality of predefined movement trajectories, wherein the trajactory parameters comprise a defined door leaf angle expressed as an absolute angle between the door leaf and the door frame, as a relative angle between the door leaf and the reference door leaf angle representing either an open position or a closed position of the door leaf with respect to the door frame.

4. The automatic door operator as defined in claim 3, wherein the memory is adapted to store the trajectory parameters of the plurality of predefined movement trajectories and function parameters of the plurality of functions being associated therewith, and wherein the controller is configured to compare the manual movement trajectory to the trajectory parameters of the plurality of predefined movement trajectories, and identify the one predefined movement trajectory.

5. The automatic door operator as defined in claim 3, wherein the controller is configured to determine a current angular position of the door leaf and to use the current angular position for detecting the manual movement trajectory of the door leaf.

6. The automatic door operator as defined in claim 5, further comprising a revolution counter for the motor, the revolution counter being connected to an input of the controller, wherein the controller is configured to use one or more readings of the revolution counter for determining the current angular position of the door leaf.

7. The automatic door operator as defined in claim 5, wherein the controller determines a time duration ($t_{dur}$) during which the current angular position of the door leaf corresponds to the defined door leaf angle and performs the selected function only if the time duration ($t_{dur}$) exceeds a threshold time ($t_{min}$).

8. The automatic door operator as defined in claim 1, wherein the selected function comprises a command for initiating, modifying or aborting another one of the plurality of functions of the automatic door operator performable by the controller.

9. The automatic door operator as defined in claim 1, wherein the controller is configured to receive an external fire alarm signal.

10. The automatic door operator as defined in claim 1, wherein the plurality of functions of the automatic door operator performable by the controller include generation of the fire alarm.

11. The automatic door operator as defined in claim 1, wherein the swing door assembly comprises a single door leaf and wherein the manual movement trajectory is detected for said single door leaf.

12. The automatic door operator as defined in claim 1, wherein the swing door assembly comprises a pair of door leaves and wherein the manual movement trajectory is detected for one of the door leaves in said pair.

13. An automatic door operator for a swing door assembly having a door leaf rotationally supported by a door frame and a linkage mechanism connecting the automatic door operator to the door leaf, the automatic door operator comprising:

a motor for causing opening of the door leaf with respect to the door frame; and a controller being configured for performing a plurality of functions of the automatic door operator, characterized in that the controller is configured to:

detect a manual movement trajectory of the door leaf, wherein the manual movement trajectory is not caused by said motor;

identify a predefined movement trajectory matching the detected manual movement trajectory;

determine, among said plurality of functions, a selected function being associated with the predefined movement trajectory; and cause performance of the selected function, wherein the automatic door operator comprises a forced closed arrangement adapted to provide mechanical energy via a transfer mechanism to the linkage mechanism, so as to cause a forced closing of the door leaf with respect to the door frame, and wherein the plurality of functions of the automatic door operator performable by the controller include generation of a fire alarm, and wherein the selected function generates the fire alarm and causes the forced closing of the door leaf with respect to the door frame.

14. The automatic door operator as defined in claim 13, wherein the manual movement trajectory represents an intentional manual movement of the door leaf by human intervention.

15. The automatic door operator as defined in claim 13, further comprising a memory, the memory being adapted to store trajectory parameters of the predefined movement trajectory, wherein the trajectory parameters comprise data representing a defined door leaf angle expressed as an absolute angle between the door leaf and the door frame, or as a relative angle between the door leaf and a reference door leaf angle representing either an open position or a closed position of the door leaf with respect to the door frame.

16. A method for providing user interaction with an automatic door operator in a door operating system comprising a door frame, a swing door assembly having a door leaf rotationally supported by the door frame, a linkage mechanism connecting the automatic door operator to the door leaf, a motor and a forced close arrangement adapted to provide mechanical energy via a transfer mechanism to the linkage mechanism so as to cause a forced closing of the door leaf with respect to the door frame in response to a fire alarm, the method comprising:

detecting a manual movement trajectory of the door leaf, wherein the manual movement trajectory is not caused by the motor of said automatic door operator;

identifying a predefined movement trajectory matching the manual movement trajectory;

determining, among a plurality of functions of the automatic door operator, a selected function being associated with the predefined movement trajectory;

causing performance of the selected function; and causing the forced closing of the door leaf with respect to the door frame in response to the fire alarm, the selected function comprises sending a control signal to the forced close arrangement.

17. The method as defined in claim 16, further comprising:

determining the current angular position of the door leaf;

determining a door leaf angle of the predefined movement trajectory;

determining a time duration ($t_{dur}$) during which the current angular position of the door leaf corresponds to the defined door leaf angle of the predefined movement trajectory; and performance the selected function only if the time duration ($t_{dur}$) exceeds a threshold time ($t_{min}$).

18. The method as defined in claim 16, further comprising:

receiving an external fire alarm signal; and generating the control signal, wherein the control signal sent to the forced close arrangement causes the automatic door operator to reset.

19. The method as defined in claim 18, further comprising:

invoking an automatic hold open function after the control signal causes the automatic door to reset.

20. The method as defined in claim 16, wherein:

the selected function further comprises generating the fire alarm, the method further comprising:

sending the control signal to the forced close arrangement upon generation of the fire alarm, causing the forced closing of the door leaf with respect to the door frame.

* * * * *